United States Patent [19]

Scribner

[11] Patent Number: 4,619,390

[45] Date of Patent: Oct. 28, 1986

[54] PNEUMATIC FEEDER FOR PUNCH PRESSES

[76] Inventor: Albert W. Scribner, 6 Country Club Rd., Darien, Conn. 06820

[21] Appl. No.: 763,777

[22] Filed: Aug. 9, 1985

Related U.S. Application Data

[63] Continuation of Ser. No. 604,031, Apr. 26, 1984.

[51] Int. Cl.[4] ..... B65H 20/18

[52] U.S. Cl. ..... 226/162; 137/82; 226/134; 226/150

[58] Field of Search ..... 226/149, 150, 151, 162, 226/167, 112, 115, 22, 134; 137/82, 84

[56] References Cited

U.S. PATENT DOCUMENTS

| | | | |
|---|---|---|---|
| 3,038,645 | 6/1962 | Nordlof | 226/149 |
| 3,159,170 | 12/1964 | Callan | 137/82 |
| 3,447,555 | 6/1969 | Jenney | 137/82 |
| 3,994,311 | 11/1976 | Walle | 137/82 X |
| 4,051,987 | 10/1977 | Scribner | 226/146 X |
| 4,059,130 | 11/1977 | Cohen | 137/82 |
| 4,160,518 | 7/1979 | Scribner | 226/162 X |
| 4,290,541 | 9/1981 | Scribner | 226/162 X |
| 4,310,114 | 1/1982 | Scribner | 226/146 X |

*Primary Examiner*—Harvey C. Hornsby
*Assistant Examiner*—Scott J. Haugland

[57] ABSTRACT

A pneumatic feeder for punch presses and the like wherein a novel circuit and arrangement is incorporated in the feeder control system for causing the stock gripping means on the reciprocating feed slide to be released in response to the completion of each intermittent stock feeding stroke of the slide. This circuit and control arrangement includes a fluid motor means that is controlled by a pilot operated supplementary valve means which in turn is controlled by an air jet means that is arranged and adapted to sense the arrival of the feed slide at a predetermined position.

7 Claims, 2 Drawing Figures

PNEUMATIC FEEDER FOR PUNCH PRESSES

This application is a continuation of application Ser. No. 604,031, filed Apr. 26, 1984.

BACKGROUND OF THE INVENTION

The earlier sensing and control system shown and described in connection with FIGS. 17–19 of my prior U.S. Pat. No. 4,051,987 for releasing the stock gripping means at the end of a feed stroke operated satisfactorily under certain conditions but the mechanical system of a movable plunger, time delay spring, etc. had some disadvantages. The use of a given spring 253 in the system shown in said Patent could not accommodate a wide range of air pressure levels that might be used operating the feeder and the resultant variations in the length of the noted time delay for the auxiliary valve action resulted in the timing of the opening of the stock gripping means possibly being either premature or excessively delayed with respect to the completion of each feed stroke of the feed slide. Also the operative displacement of the sensing plunger 250 shown in said Patent had to commence at a point located at a considerable distance from the end of the feed stroke of the slide and this contributed to some degree to an uncertainty in the timing of the said stock release action. Further this prior system required close manufacturing tolerances for the spring 253 and little if any effective adjustment was possible after the arrangement was assembled.

SUMMARY OF THE INVENTION

The present invention overcomes the problems noted above in that said plunger, spring etc. are eliminated and an air jet means having no moving parts is provided which is substantially free of wear, needs no adjustment, and operates only when the feed slide is much closer to the end of its feed stroke thereby permitting the required time delay action for the stock grip release to be very short without being premature. The air jet means senses when the feed slide has very nearly completed its feed stroke, and thereafter developes and output signal that operates an air piloted control valve that can quickly exhaust the stock gripping fluid motor means carried by the feed slide so as to thereby release the feed grip on the stock. This release allows the stock to be finally positioned by the action of the associated die pilot pins in a manner well understood in the art. At the same time if desired a stationary stock gripping means may be provided and controlled so as to clamp the stock in its then advanced and/or adjusted position.

The primary object of the invention is to provide pneumatically operated punch press feeder having a simple, reliable, durable and quick acting air jet type sensing means for operating a valve means for controlling one or more fluid motors of the feeder whereby close control may be maintained over the stock feed action of the feeder.

DETAILED DESCRIPTION OF THE INVENTION

Figures 1, 2:
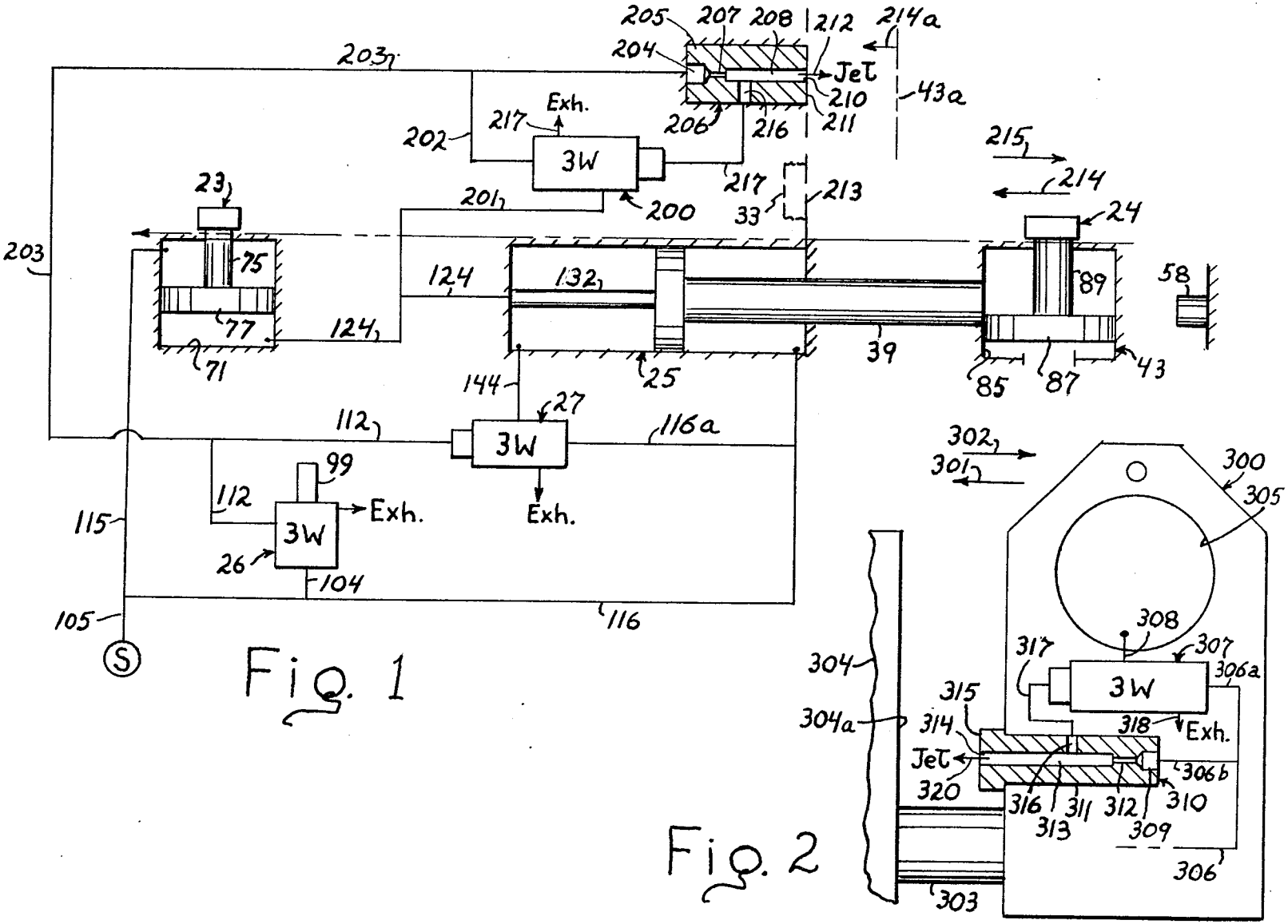
FIG. 1 is a schematic diagram illustrating one embodiment of the present invention as applied to a single slide pneumatic feeder of the type illustrated in U.S. Pat. No. 3,038,645.
FIG. 2 is a schematic diagram illustrating another embodiment of the invention as applied to a dual slide feeder of the type illustrated in my prior U.S. Pat. No. 4,310,114.

The circuit and control arrangement of the present invention can be used with various types of pneumatically operated punch press feeders and for illustrative purposes there is shown in FIG. 1 a feeder that is structurally similar to the feeder shown and described in U.S. Pat. No. 3,038,645; the disclosure in this Patent being incorporated herein by reference. If details of the structure of the FIG. 1 feeder are desired reference may be made to this Patent, and unless otherwise indicated reference numerals used herein that are the same as those used in said U.S. Pat. No. 3,038,645 designate like parts and elements. As indicated in said U.S. Pat. No. 3,038,645 the yieldable stock clamping means 23 of FIG. 9 thereof is used when as here the die pilot pins are to be used. The control circuitry for the fluid motors of the feeder illustrated in FIG. 1 herein may also be considered to be the same as that illustrated in FIG. 2 of said U.S. Pat. No. 3,038,645 to the following extent. For producing the usual reciprocating movement of the feed slide 43 in feed and index directions 214,215 respectively in response to the upward and downward movements respectively of the main control valve plunger 99 the rod ends of the double acting fluid motor means 71,75,77 for operating the stationary stock gripping of clamping means 23 of FIG. 9 of said patent are air pressure biased through line 115 from the supply line 105, the normally open main three way valve 26 is supplied with pressure air through line 104, and the rod end of the main fluid motor 25 and the inlet line **116*a* to the air piloted normally open three way valve 27 are supplied with pressure air through line 116 from supply line 105. The above noted elements function as before, i.e. as described in said U.S. Pat. No. 3,038,645, however here the rod ends of the single acting fluid motor means 85,87,89 carried by the feed slide for operating the movable stock gripping means 24 and the head end of the fluid motor means 71,75,77 carried by the main feeder block for operating the stationary stock gripping means 23 are controlled through line 124 by the output line 201 of a pilot operated supplementary air control valve 200. Valve 200 is similar to said valve 27 and may comprise any suitable type of air piloted normally open three way valve well known in the art. An inlet line 202 is connected at one end thereof to the air inlet of the valve 200 and at the other end thereof to a line 203 which in turn is connected to the main valve output line 112. The outer end of line 203 is connected to an inlet line 204 formed in a cylindrical valve body 205 of an air jet sensing means 206. The jet valving body 205 is axially formed with a small diameter venturi or jet orifice nozzle 207 that is connected between said inlet line or conduit 204 and a downstream line 208 that ends at an outlet opening 210 in the flat outer end face 211 of the cylindrical valve body 205**.

As will be apparent when pressure air flows through the nozzle 207 and through line 208 a sensing air jet 212 will be established through said end opening 210. The valve body 205 is mounted and secured by any suitable means on or in the main body of the feeder such that as illustrated in FIG. 1. Said end face 211 is located substantially flush with the outer plane 213 of the cover plate 33 (see FIG. 4 of said U.S. Pat. No. b 3,038,645) so that when feed slide 43 completes a feed stroke after moving in a feed direction as illustrated at **214*a* of FIG. 1 the forward flat face of the feed slide as diagrammatically illustrated at 43***a* will move to and cover the said end opening 210 of the air jet means. The cylindrical valve body 205 is formed with a radially disposed output line 216 that communicates at one end thereof with said downstream line or conduit 208 and at the other end thereof with an output signal line 217 that controls the operation of said air piloted three way valve 200. The above described control arrangement for valve 200 and the air jet sensing means 206 is such that when pressure air flows into line 203 from the output line 112 of the normally open main valve means 26 it will be conducted through the normally open valve 200 and its output line 201 and line 124 so as to cause the stock gripping means 23 to a shift to a stock release condition and the movable stock gripping means 24 to shift to a stock gripping condition. At the same time the air jet means 206 will also be supplied with pressure air from line 203 and hence jet 212 will be established. As long as the end opening 210 is not covered or otherwise blocked by the said forward face 43*a* of the feed slide the air pressure in the signal output line 216 will not be high enough to cause the piloted valve 200 to be shifted from its said normally open to a closed condition. When however the feed slide arrives at the end of a feed stroke and its forward face 43*a* thereby covers or blocks said opening 210 the air pressure in the signal output line 216 will quickly build up so as to cause valve 200 to be shifted to its closed or exhaust condition wherein air pressure from line 201 will be exhausted through the exhaust line 217 of the valve 200 so that the stock gripping means 23 will be shifted to a yieldable stock clamping condition (note again FIG. 9 of said U.S. Pat. No. 3,038,645) and stock gripping means 24 will be shifted to a stock release condition. As indicated in U.S. Pat. No. 3,038,645 the grip means 24 is spring biased to a normal stock release condition. The slight time delay required for completion of the noted pressure build up in line 216 and the resultant shifting of the valve 200 will insure that the stock is not released by gripping means 24 prior to completion of the feed stroke of feed slide 43. As will be seen then the FIG. 1 feeder arrangement will operate as before, i.e. as described in said U.S. Pat. No. 3,038,645, except that now the operation of the jet sensing means 206 will cause the condition of the stock gripping means 23 and 24 to be shifted in response to and after the completion of each feed stroke of the feed slide 43.

Briefly reviewing the overall operation of the FIG. 1 feeder and its controls, when the control plunger 99 of the normally open main valve means 26 is depressed in response to the downward movement of the associated press ram the valve means 26 will be shifted to its exhaust condition, this permitting the normally open valve means 27 to open whereby pressure air will be supplied through output line 144 to the head end of the main fluid motor 25 which will cause feed slide 43 to be displaced through an index stroke in the index or non-feed direction 215. During this index stroke yieldable clamping means 23 remains in a closed or clamping condition while the gripping means 24 remains in an open or released condition; this being due to the normally open valve means 26 and 27 then being in their closed and open conditions respectively, and the normally open valve means 200 being in an open condition because there is no pressure air in lines 203 or 217. When plunger 99 is permitted to move upwardly in response to the upward movement of the press ram the main valve 26 will be restored to its normally open or pressure air conducting condition wherein pressure air now flowing into the valve output line 112 will pass through line 203 and 202, normally open valve 200, lines 211 and 124 to thereby cause clamping means 23 to release and grip means 24 to grip the stock. Pressure air in said main valve output line 112 will also cause the normally open valve 27 to be shifted to a closed condition so that the head end of the main fluid motor means 25 (whose rod end is continuously air biased through supply line 116) will then be exhausted and feed slide 43 will thereby partake of a feed stroke in said feed direction 214. The pressurizing of said valve output line 112 will also pressurize line 203 and hence the air jet 212 will be established and will continue during the said feed stroke of the slide 43. When the slide has almost (i.e. within 0.010 to 0.015 or so inches) reached the end of its feed stroke the forward face 43*a* thereof will begin to significantly interfere with the air jet 212 and the pressure build up will begin to occur in said line 208 until, when said jet outlet opening 210 is covered or otherwise substantially blocked by said front face 43*a* of the slide, an output air pressure signal is generated in line 216 of sufficient pressure magnitude to shift the normally open valve 200 to its closed or exhausting condition whereupon both stock gripping means will be shifted, i.e. means 23 to a yieldable clamped condition and 24 to a release condition, and will remain so shifted until the next downward movement of the control plunger 99 initiates the next index stroke of the feed slide as above described. As previously indicated the slight time delay required for said pressure build up and the resultant shift of the valve 200 will insure that the feed stroke is completed before the stock is released by grip means 24. A second embodiment of the present invention is illustrated in FIG. 2 which shows one slide of the dual slide feeder shown and described in my prior U.S. Pat. No. 4,310,114; the disclosure in this Patent being incorporated herein by reference. This second embodiment of the invention also utilizes an air jet sensing means whereby when each feed slide arrives at the end of a feed stroke an associated air jet sensing means and associated valve means will operate to thereafter exhaust the grip motors on the slide so as to release the stock for any final positioning by the noted die pilot pins.

In that both feed slides of the dual slide feeder of FIG. 2 are equipped with the same air jet and valve control means a description here of just one such jet and valve control means will suffice. Referring to FIG. 2 the feed slide 300 is adapted to be reciprocated in feed and index directions 301 and 302 respectively by the piston rod 303 of the main fluid motor means disposed in the main block 302 and associated with the feed slide 300. The single acting fluid motor means indicated at 305 (corresponding to the stock gripping motor 13 in said U.S. Pat. No. 4,310,114) is adpated to be filled with pressure air from line 306 (which line corresponds to passage 22 shown in said U.S. Pat. No. 4,310,114 ) through a line 306*a* that is connected to the inlet of an air piloted normally open supplementary air three way valve 307 and through said valve 307 and its output line 308; the latter being connected to the head end of said fluid motor 305. The line 306 is also connected through line 306*b* to the inlet passage 309 of an air jet means 310 that is constructed and operates in substantially the same manner as that shown and described above in connection with FIG. 1. Here the cylindrical main body 311 of the air jet means 310 is axially formed with a venturi orifice or nozzle 312 that connects the inlet passage 309 with a downstream line or conduit 313 that ends in an opening 314 in the flat forward end face 315 of said air jet body 311. The body 311 is also formed with a radially disposed output signal line 316 that is connected between said line 313 and the pilot control line 317 for the said valve 307, the latter being provided with an exhaust line 318. The air jet means 310 is mounted and secured in the feed slide 300 in any suitable manner so as to be located therein in the position illustrated in FIG. 2.

In the operation of the dual slide feeder embodiment of FIG. 2 when feed slide 300 is in an indexed position and a feed stroke is to be initiated pressure air flows into line 306 from the main rotary or primary valve means of the feeder and such air will flow through the normally open valve 307 and its output line 308 to the fluid motor means 305 for gripping the stock, whereafter the main piston rod 303 will move the feed slide 300 through a feed stroke in said feed direction 301. During this feed stroke the sensing air jet 320 will be established and directed in a stock feed direction 301 from the then pressurized line **306*b* and through the end opening 314 in a manner similar to that described above in connection with the air jet means for the FIG. 1 circuit. Just before the flat forward abutment face 315 of the jet valve body contacts the adjacent flat end or abutment wall 304*a* of the said main feeder block 304 near the end of a feed stroke, an air pressure build up will begin to occur in line or conduit 313 until the jet opening 314 is finally blocked by the engagement of said face 315 with the said abutment wall 304*a* whereupon a pressure output signal will be developed in line 316 which through pilot control line 317 will cause valve 307 to be shifted to its closed or exhaust condition. This valve shift will cause the fluid motor means 305 to be exhausted through the valve exhaust line 318 whereby the associated stock gripping means on the feed slide 300** will be shifted to a stock release condition.

As will be apparent when each feed slide completes it feed stroke the operation of each associated air jet means such as 310 and associated valve means such as 307 will cause the respective stock gripping means on said slides to move to a release condition; this operation of the FIG. 2 air jet means and associated valve means corresponding to that described above for the air jet and associated valve means of FIG. 1.

I claim:

1. In a pneumatic feeder for intermittently advancing stock into the work station of a punch press or the like, and having a frame;

feed slide means mounted on said frame for reciprocating movement in index and stock feed directions;

actuating means for actuating said feed slide means in said index and feed directions;

stock gripping means carried by said feed slide means and adapted to be moved between stock releasing and stock gripping conditions;

fluid motor means for actuating said stock gripping means; and control means for controlling the operation of said actuating means and fluid motor means whereby said stock may be intermittently gripped and advanced in said feed direction, said control means including a primary air valve having an output line for normally controlling the operation of said fluid motor means;

the improvement comprising a piloted supplementary air valve having a first operative condition for normally permitting said primary air valve to control said fluid motor means, and a second operative condition for overrriding the said normal control of said fluid motor means by said primary air valve and for controlling said fluid motor means so as to cause said stock gripping means to be moved to a stock releasing condition independent of, and without controlling, the operation of said actuating means for said feed slide means;

air jet means adapted to issue a jet of air for sensing the arrival of said feed slide means at the terminal portion of a feed stroke of said feed slide means, and for generating an output signal when said arrival in sensed, said air jet means comprising a nozzle and means defining a signal output line, said air jet means being adapted to generate an air output signal for controlling said supplementary air valve; and fluid operated means responsive to an output signal from said air jet means for shifting said supplementary air valve from its said first operative condition to its said second operative condition when said air jet means senses the completion of a stock feed stroke of said feed slide means for causing said fluid motor means to operate so as to permit said stock gripping means to move to a stock releasing condition shortly after completion of said stock feed stroke and without causing the initiation of an index stroke of said feed slide means.

2. Apparatus as defined by claim 1 wherein said air jet means is carried by said feed slide means.

3. Apparatus as defined by claim 1 wherein said supplementary air valve is carried by said frame.

4. Apparatus as defined by claim 1 wherein said air jet means is provided with an inlet line that is coupled to said output line of said primary air valve.

5. Apparatus as defined by claim 4 wherein said supplementary air valve comprises a pilot operated three-way valve.

6. Apparatus as defined by claim 1 wherein said air jet means is carred by said frame.

7. Apparatus as defined by claim 1 wherein said air jet means includes means defining a conduit disposed downstream from said nozzle, and wherein said signal output line communicates between said downstream conduit and said fluid operated means for shifting said air piloted supplementary valve.

* * * * *